US006929120B2

(12) United States Patent
Zonker et al.

(10) Patent No.: US 6,929,120 B2
(45) Date of Patent: Aug. 16, 2005

(54) CURVED BACK RECLOSABLE METAL PACKAGING UNIT

(75) Inventors: Harry R. Zonker, Pittsburgh, PA (US); Michael J. Anthony, Pittsburgh, PA (US); Richard R. Mathabel, Lower Burrell, PA (US); Eileen M. Kenzevich, Apollo, PA (US); Mark S. Abel, Walland, TN (US)

(73) Assignee: Alcoa Inc., Pittsburgh, PA (US)

( * ) Notice: Subject to any disclaimer, the term of this patent is extended or adjusted under 35 U.S.C. 154(b) by 72 days.

(21) Appl. No.: 10/387,880

(22) Filed: Mar. 12, 2003

(65) Prior Publication Data

US 2004/0178088 A1 Sep. 16, 2004

(51) Int. Cl.[7] ..... B65D 85/10

(52) U.S. Cl. ..... 206/268; 206/205; 220/254.3

(58) Field of Search ..... 206/204, 205, 206/200, 242, 265, 268, 271; 131/302, 303; 312/31, 31.01, 31.03; 220/254.1, 254.3, 254.9

(56) References Cited

U.S. PATENT DOCUMENTS

| | | | | | |
|---|---|---|---|---|---|
| 812,175 | A | * | 2/1906 | Marcuse | 206/265 |
| 874,337 | A | * | 12/1907 | Helm | 220/844 |
| 885,374 | A | * | 4/1908 | Pohlig | 206/265 |
| 898,125 | A | * | 9/1908 | Marcuse | 206/265 |
| 1,150,443 | A | * | 8/1915 | Marcuse | 206/265 |
| 1,152,429 | A | * | 9/1915 | Marcuse | 206/265 |
| 1,510,429 | A | * | 9/1924 | Watson | 206/261 |
| 1,711,971 | A | | 5/1929 | Schulze | |
| 1,746,030 | A | * | 2/1930 | Cordani | 206/265 |
| 1,770,920 | A | * | 7/1930 | Hermani | 220/8 |
| 1,897,702 | A | * | 2/1933 | Lewnes | 206/255 |
| 2,112,801 | A | * | 3/1938 | Zint | 206/253 |
| 2,138,916 | A | * | 12/1938 | Gaess | 206/265 |
| 2,157,255 | A | * | 5/1939 | Bumpass | 229/5.5 |
| 2,179,227 | A | * | 11/1939 | Caten | 229/5.6 |
| 4,997,082 | A | * | 3/1991 | Durocher | 206/204 |
| 5,238,140 | A | * | 8/1993 | Maze | 220/506 |
| 5,526,559 | A | | 6/1996 | Fleenor et al. | |
| 5,542,529 | A | | 8/1996 | Hein, III | |
| 5,934,461 | A | | 8/1999 | Fleenor et al. | |
| 6,016,916 | A | | 1/2000 | Ortner | |

OTHER PUBLICATIONS

TR–Online, Hip New Pack, Apr. 2002.
Cara Dipasquale, RJR Puts Tobacco In A Flask, Jan. 30, 2002.
RJR, RJR Packaging—Products, 2002.
RJ Reynolds Tobacco Company, Inside RJRT—RJR Packaging.

* cited by examiner

*Primary Examiner*—Luan K. Bui
(74) *Attorney, Agent, or Firm*—Eckert Seamans Cherin & Mellott, LLC

(57) ABSTRACT

A packaging unit (10) for containing, for example cigarettes (44) has a body made of curved metal (12) and curved metal back (14) surfaces connected by metal sides (16), and a metal bottom (20), preferably having a central raised exterior part or bottom (42) surrounded by a ridge (40), with a lid (22) having a straight hinge (24) across the top, where the unit is capable of hermetic sealing.

11 Claims, 5 Drawing Sheets

CURVED BACK RECLOSABLE METAL PACKAGING UNIT

FIELD OF THE INVENTION

The present invention relates to a metal packaging unit for solid products, that has a body-contoured, curved back for ease of carrying in clothing, that is reclosable and that could be hermetically sealable to insure the freshness of its contents. One particularly useful application for this container would be as a cigarette package.

BACKGROUND OF THE INVENTION

Cigarettes are packaged in primarily two types of packaging units, known in the industry as the 'soft pack' or 'hard pack'. Both packages provide limited product protection from damage through end use and offer little ability to maintain freshness. Additionally limited ability exists to produce unique shapes that enable the product to be distinguished from other paper or paperboard packages that are folded into a rectangular shape. The current hard and soft packs also create a post consumer waste issue, since the cigarettes are generally packaged within three layers, and internal foil wrap, the paper or paperboard package, and a cellophane overwrap. Conventionally, after cigarettes have been manufactured they are accumulated and separated into a three-row stack of 20, which has a "7-6-7" configuration. This 7-6-7 stack is then wrapped with foil and next mechanically transferred to a station in which paper, for a softpack, or paperboard, for a hardpack, is folded around the foil wrapped cigarettes. A cellophane wrap is then applied around either the soft or hard pack.

One of the first attempts to provide a protective metal case for cigarettes was by Schulze in U.S. Pat. No. 1,711,971, which issued in 1929. There a flat-sided metal container having a rectangular internal area and a hinged top lid was used to contain a standard pack of cigarettes. This construction allowed cigarettes to be removed using the standard industry test whereby the case could be grasped with one hand, and the thumb of the same hand used for flipping open the cover, whereby a cigarette could be readily grasped at its protruding end and removed and the cover snapped closed by the index finger of the same hand, by which is had been opened. A particular advantage of this case allowed ease of opening by pressing against diagonally opposite corners of the box. In this action the upper edge of the box was deformed slightly from rectangular to an oblique parallelogram form so that the forward rim of the box drew inward away from a flange of the cover, and the indentation receded from the cover indentation releasing the lock. The pressure of the forward edge of the lateral rim of the box against the rim of the cover flange caused the latter automatically to snap upward about its hinge to open position. The box immediately resumed its rectangular form by reason of the resiliency of the thin metal of which it was made. This design also contemplated a humidor pad in the top of the lid. This box was, however, completely separate from the standard cigarette package, acting as a holder for the cigarette package, and the hard square edges did not provide ease of carrying.

Standard cigarette packages are usually made from three wrappings: an inner foil liner made from a metal foil laminated to a paper substrate or a metallized paper, which is wrapped about the cigarettes and folded, but not sealed, at the ends of the cigarettes; a "soft" or "hard" paper or paperboard package that is usually imprinted with a brand name and other information; and an exterior clear overwrap of a heat sealable polymeric film, usually polypropylene, which is heat sealed. A strip of polymeric material known as a "tear tape" is usually provided for easy opening of the polymeric overwrap films. The tear tape is positioned adjacent and parallel to the top edge of the package.

The foil inner liner is only folded over the top and bottom of the cigarettes and provides a minimal barrier to oxygen in surrounding air. The heat sealed overwrap slows the loss of moisture, freshness, and flavor only over a period of weeks. Hein, III et al. in U.S. Pat. No. 5,542,529 partially solved the moisture and freshness problem by providing a heat sealable high barrier packaging material made from a base layer of either oriented polypropylene, nylon, or biaxially oriented polyethylene terephthalate film that was metallized by vacuum deposition techniques. This barrier can then be printed with brand and other information followed by application of inner and outer heat seal film. This protective packaging could have as many as five separate layers.

Recently a flask-shaped cigarette pack made of recyclable plastic that is water-resistant and crushproof, named the Evo Flask was introduced in the United States. It has a 2-by-10 cigarette configuration, is slim and curved and was marketed by R.J. Reynolds in April to June of 2002, as described on http://tobaccos.com/backissues/Apr2002/story4.asp and http:/adage.com/news.cms new Id=33939. This product was advertised by at least September 2002 in for example Newsweek, Sep. 30, 2002, sandwiching p. 38p. Other R.J.R. packaging efforts are described in http://www.rjipackaging.com/frtobaccopack.html and http://www.rjrt.com/IN/COpurch_flax_packaging.asp. However, by using a design with an altered width, which enables a 2×10 configuration, the design does not take advantage of the nesting associated with a 7-6-7 configuration and could result in looser packing of the cigarettes and may contribute to a flattening of the cigarette sides. The altered dimensions also require modification to the point of sale dispensers. The design as shown is not directly transferable to a drawn aluminum package due to the sharp square corners at the bottom of the package. Bottom corners must be rounded to enable deep drawing the package without fracturing. Another feature of the package, is that package lid is attached using two small semicircular connector straps, one positioned at each of the back corners, to prevent interference between the lid and body upon opening. This method would likely be less durable upon repeated opening and closing of the package than a continuous hinge as to be described in this patent.

U.S. Pat. Nos. 5,526,559 and 5,934,461 (both Fleenor et al.) recognized disposal problems associated with standard paper-plastic film wrapped cigarette packages and taught an aluminum, cigarette package having improved crush resistance and recyclability made by a seamless aluminum drawing method where the body and a stamped or punched lid were independently formed and then joined at inherently sealed edges. This provided a sole metal cigarette holder having flat surfaces, which are rounded at the edges, a front panel shorter than the back panel allowing for ease of closing the lid, and a rectangular shape. This did away altogether with the standard paper cigarette holder and inner foil liner. The lid design used, would require adhesively backed tape to attach the lid and body, which also serves as the hinge.

U.S. Pat. No. 6,016,916 (Ortner) extended the use of metal or plastic packaging units to contain rod shaped perfume bottles. The packaging unit had flat surfaces, a rectangular shape and front panels shorter than the back panels allowing ease of closing the lid.

What is still needed is a body hugging, reclosable packaging unit with a simple lid design that addresses the post-consumer waste issue. It is a main object of this invention to provide such a reclosable packaging unit with a simple lid design that is capable of being hermetically sealed in order to improve content freshness.

SUMMARY OF THE INVENTION

The above needs as well as other deficiencies of the prior art are solved by providing a packaging unit having: a body portion comprising a curved metal front and curved back metal surface connected by metal sides; a bottom metal portion that provides stability; and a lid attached to the front, back and side surfaces, the lid having a straight hinge across the top, said packaging unit being capable of being opened and closed repeatedly.

The invention also resides in a preferred embodiment as a packaging unit having: a body portion comprising a curved metal front and curved back metal surface connected by metal sides; a stable bottom metal portion having a central raised exterior bottom surrounded by a ridge; and a lid attached to the front, back and side surfaces, the lid having a straight hinge across the top; said packaging unit being capable of being opened and closed repeatedly.

Preferably the lid will be made of aluminum to assure good bonding/contact with the metal body but the lid can also be plastic. Even though the lid will have a curved/rounded cross-section, the straight top hinge will allow easy opening and closing. The use of curved containers of this type in the past has been hampered by problems associated with opening and closing a curved top/side surface due to hinging along the back surface. Preferably the body portion will be aluminum alloy metal and have a recessed bottom to provide stability and prevent corner damage to the cigarette. Optionally, on the bottom ridge created by the recess also provides a location to place a moist humidor material. This packaging unit could contain cigarettes or other tobacco products such as small cigars, pipe tobacco and the like, or medicine in pill form.

Other aspects and advantages of the invention will occur to persons skilled in the art from the following detailed description. The invention also resides in a method comprising the steps: drawing a metal sheet at least twice, using a punch and die, to provide a deep drawn shape of curved cross-section, where in the final draw, a recessed bottom is formed by the punch at the end of the press stroke; and then optionally, applying an interior coating; optionally inserting a humidor material to the interior of the shape within a channel formed by the ridge; then inserting the contents into the interior of the packaging unit; and then applying a lid having a straight hinge across the top of the shape to provide a packaging unit; then optionally placing the packaging unit with its lid in a vacuum chamber and applying a vacuum; then closing the packaging unit and optionally releasing the vacuum and removing the packaging unit from the vacuum chamber. In another embodiment the invention also resides in a method of making a packaging unit comprising: (a) uncoiling a strip of pre-coated or pre-decorated aluminum sheet and optionally embossing the front surface with an appropriate die forming process; (b) roll forming, using a series of rolls, into the desired cross section, where the cross-section is continuously seamed and sheared to the desired length; (c) seaming a bottom piece onto the cross-section; (d) inserting contents into the interior of the packaging unit; (e) applying a lid having a straight hinge across the top of the shape to provide a packaging unit; (f) optionally placing the packaging unit with its lid in a vacuum chamber and applying a vacuum; (g) closing the packaging unit; and (h) optionally, releasing the vacuum and removing the packaging unit from the chamber.

BRIEF DESCRIPTION OF THE DRAWINGS

The invention will become more apparent in view of the following non-limiting drawings in which.

DETAILED DESCRIPTION OF PREFERRED EMBODIMENTS

Figure 1:
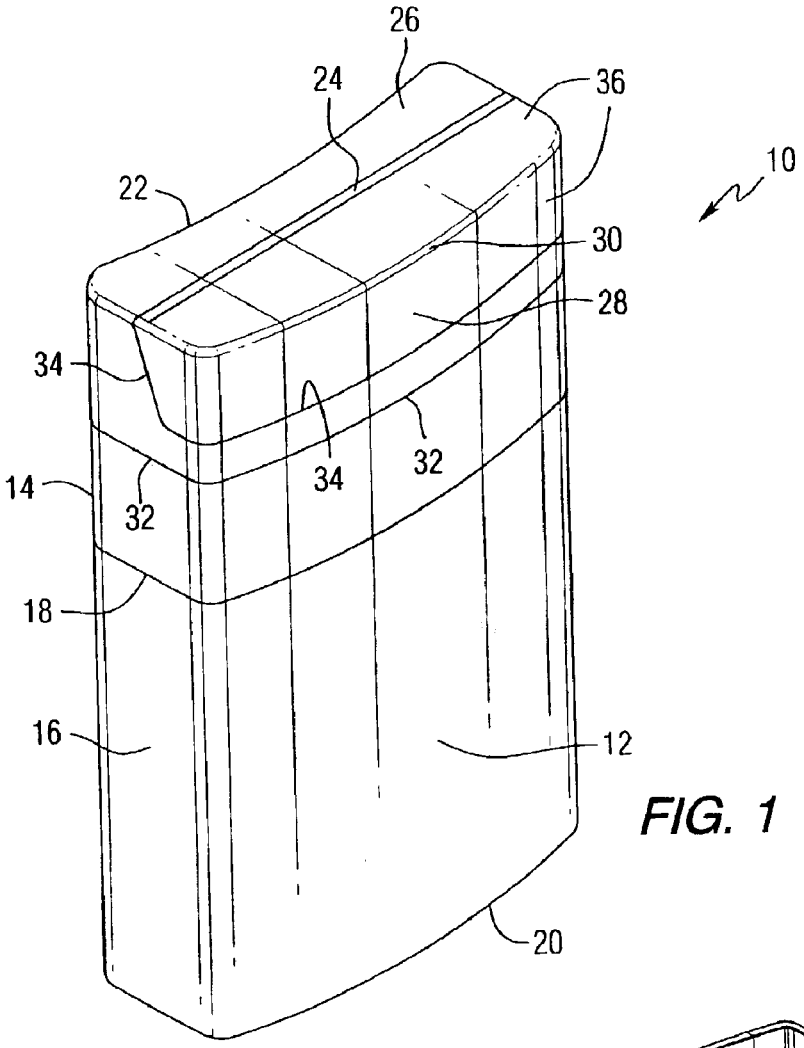
FIG. 1 is a three-dimensional isometric view of one embodiment of the curved packaging unit of this invention with a lid having a straight hinge across the top of the lid.

Referring now to FIG. 1, one preferred, deep drawn embodiment of a packaging unit 10 is shown, having a curved metal front 12, a curved metal back 14 (not shown in FIG. 1) with the front and back connected with straight metal sides 16. The packaging unit may be one piece but is more economically manufactured in two pieces and then attached, by one of a process selected from adhesively bonding or laser welding seam 18 connection.

Figure 9:
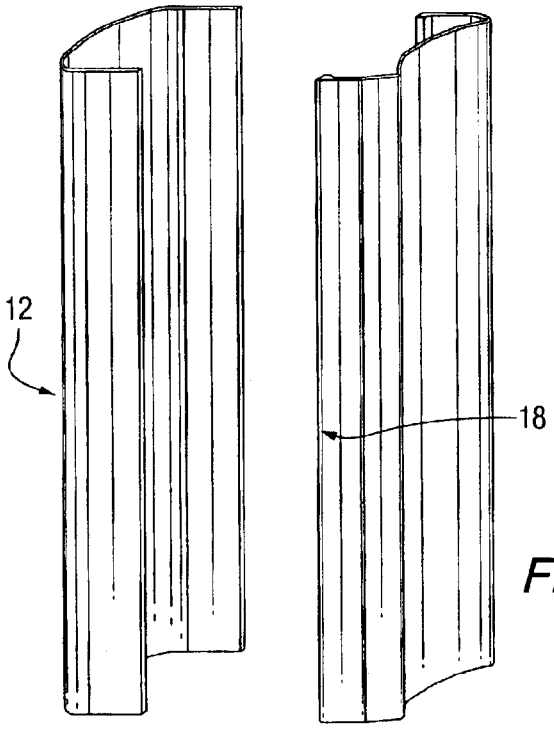
FIG. 9 is a three dimensional isometric view of two halves of a shallow drawn packaging unit with a seam along the length of the sides of the unit.
Figure 10:
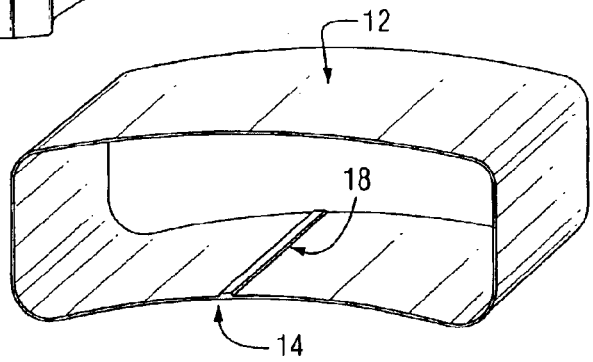
FIG. 10 is a three dimensional isometric view of a central section of a roll formed packaging unit with one seam up the back of the unit.
Figure 11:
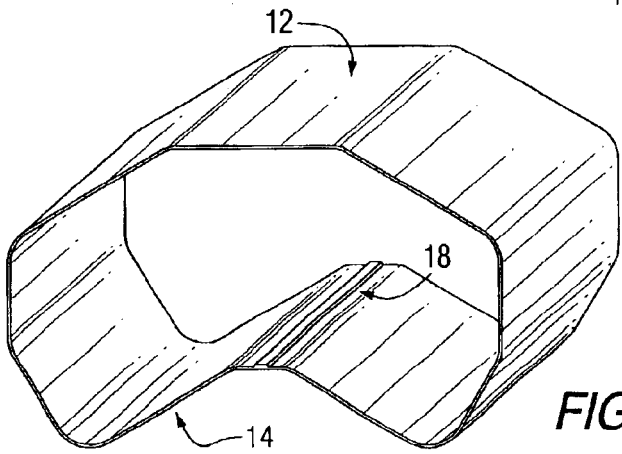
FIG. 11 is a three dimensional isometric view of a central section of another type roll formed packaging unit with one seam up the back of the unit.

The seam 18 in this preferred deep drawn embodiment will be across the front, sides and back of the container as shown in FIG. 1. In other embodiments, the seam may be up both sides or up the back, as shown in FIGS. 9–11. The preferred metal bottom 20 is of a stable design that prevents cigarette corner damage, best shown in FIG. 5. The high cost of tobacco products, particularly cigarettes and the current emphasis on reducing waste disposal problems has made metal containers, such as aluminum, feasible for packaging tobacco products. The aluminum is recyclable and can now be made very thin yet still strong. The use of metal packaging units also allows such packaging to be hermetically sealable insuring the freshness of its contents, whether it be cigarettes or medicine in pill form.

When aluminum is used as the metal, it is preferably about 0.10 mm to 0.23 mm (0.004 in to 0.009 in.) thick, most preferably 0.15 mm to 0.20 mm (0.006 in. to 0008 in) thick. The interior can have a thin plastic coating from about 0.005 mm to 0.018 mm (0.0002 in. to 0.0007 in.) thick to insure a non-reactive interior metal surface. The aluminum would most generally be an aluminum alloy containing >90% aluminum and at least one of the alloying elements Cu, Mn, Mg, such as 3004 type aluminum alloy (aluminum plus Cu, Mn, Mg) which would be compatible with can body stock alloys making it easily absorbed into the can recycling stream. Since the cigarettes would be inserted directly into the package and since the seal will be much better than paper or paperboard, the foil liner and cellophane overwrap can be eliminated, helping to reduce costs and minimize post consumer waste.

Figure 2:
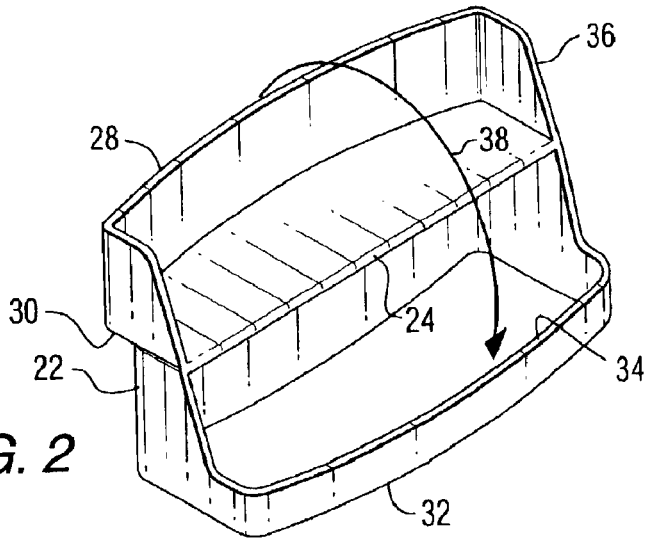
FIG. 2 is a three dimensional isometric view of the lid of the packaging unit shown in FIG. 1, with the lid open.
Figure 3:
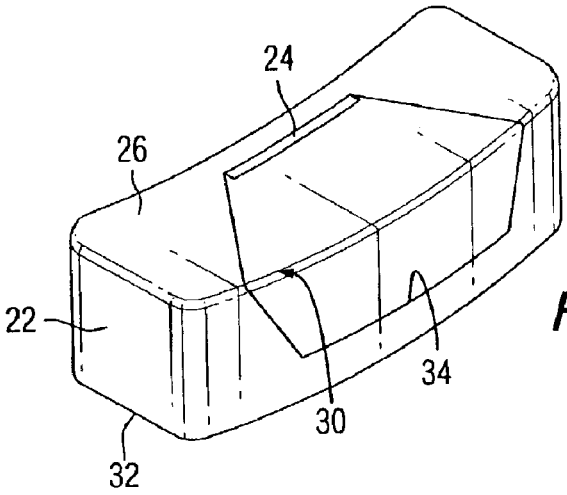
FIG. 3 is a three dimensional isometric view of another embodiment of a lid in the closed position, having a straight hinge across the top of the lid.
Figure 4:
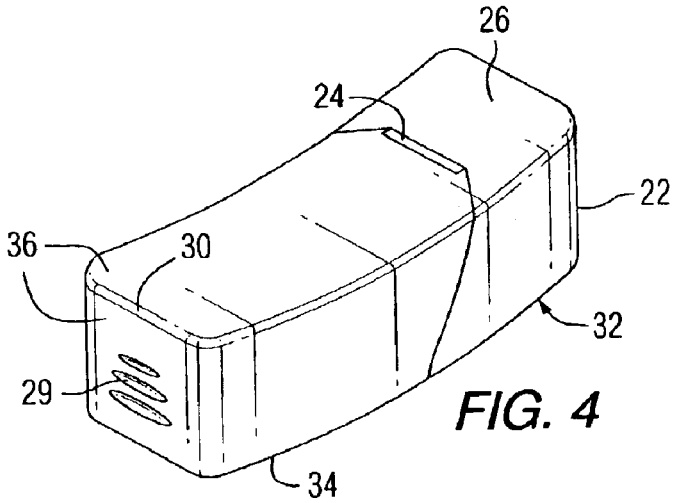
FIG. 4 is a three dimensional isometric view of another embodiment of a lid in a closed position, having a straight hinge from the front to the back of the top of the lid.

One design of a lid 22 is shown closed in FIG. 1, separated and open in FIG. 2 and alternate designs are shown separated and closed in FIGS. 3 and 4. Preferably the lid will be aluminum to provide a long lasting hinge 24, but can also be made of plastic. Due to the curved front and back design, the hinge 24 must be straight across the top 26 of the lid 22. The hinge can be from side to side as shown in FIGS. 1–3, or in some designs, might be from front to back as shown in FIG. 4. The end can be opened by pressing in at the front 28 or edge 30 of lid 22 in FIG. 1 or side 29 of lid 22 as shown in FIG. 4, followed by slight diagonal or upward pressure at front edge 30 for opening the lid.

Optionally, the lid 22 can be hermetically sealed at interface edges 32 and 34 by applying a foil seal during lid manufacturing that can either be removed from exterior of package or perforates upon opening during initial use. The curved front and back provide a "hip flask" type design with rounded edges allowing ease and comfortable carrying of the packaging unit in the shirt pocket, pants pocket and the like, and provides a pleasing luxurious look. The metal front or back exterior surface can be embossed or printed with information such as a brand name, content listing or other suitable information (not shown). The back can also be printed. As an alternative to printing the package could be shrink wrapped after filling and sealing, which permits high resolution graphics.

Figure 7:
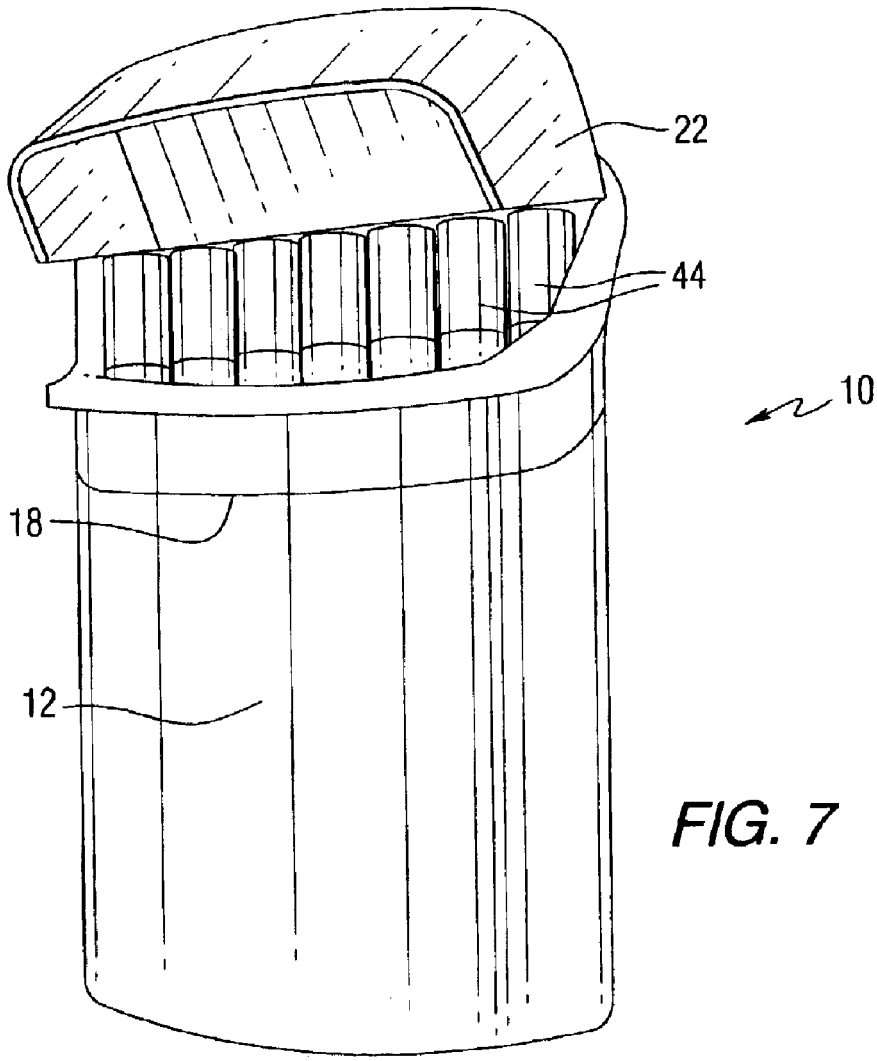
FIG. 7 is a three dimensional isometric view of a cigarette container having an open lid with an extended lip design and containing cigarettes.

Referring now to FIG. 2, the first or primary lid 22 of FIG. 1 is shown open and is of a somewhat similar design to that shown in FIG. 7. The top of the second or secondary lid 36, disposed in primarily lid 22, as shown, will close as shown by arrow 38. Another somewhat similar design is shown in FIG. 3. FIG. 4 shows another design where the lid 22 closes along a side edge and the hinge 24 is arranged in a front to back arrangement. As can be seen, a wide variety of designs are possible and FIGS. 2–4 are not to be considered limiting in any fashion.

Figure 5:
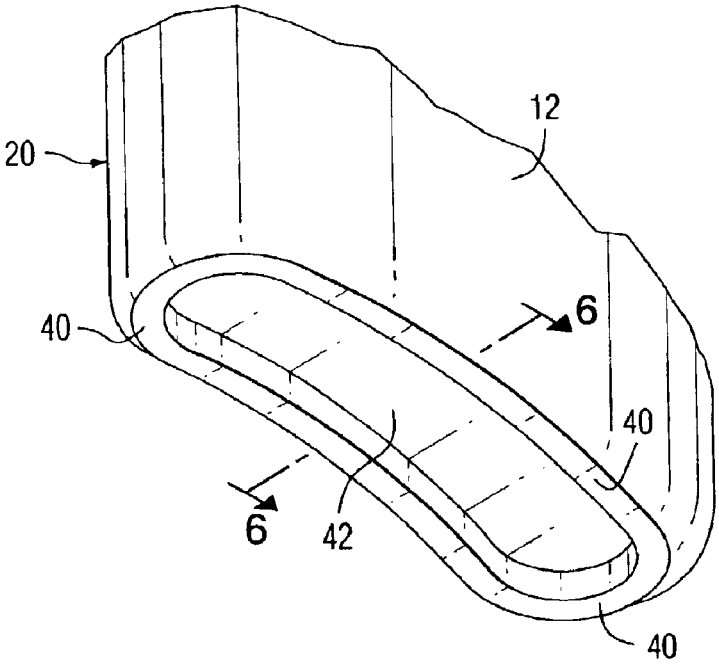
FIG. 5 is a cut-off, three dimensional isometric view of the bottom left side, showing the stable bottom design having a central section that is raised within the interior portion of the unit, providing an exterior outer rim/ridge and an interior circumferential channel.
Figure 6:
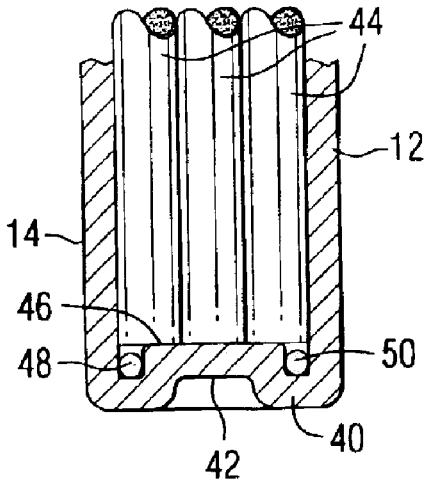
FIG. 6 is a cross-sectional isometric view through FIG. 5, showing the rim/ridge and interior channel of the packaging container.

FIG. 5 illustrates the preferred, stable bottom portion of the packaging unit 20. By "stable" is meant a bottom configuration, that unlike current hard or soft pack designs, will easily remain standing upright on a flat or even near flat surface due to an exterior circumferential rim or ridge 40, which also provides an interior channel (not shown) surrounding a raised exterior central section 42, which also provides a raised interior section (not shown) for cigarettes 44 shown in FIG. 7 or the like to sit on and prevents corner damage to cigarettes unlike prior art drawn packages. FIG. 6, better shows this arrangement, also illustrating the interior top portion 46, and interior channel 48, where a porous wicking or humidor material 50 containing a liquid can be placed to preserve the humidity and freshness of the contents. As can be seen, this provides a very stable bottom surface even though the packaging unit is only from about 2 cm to 3 cm wide. FIG. 7 shows the complete product open and containing cigarettes, where a fancy bottom of the closure is illustrated.

Figure 8:
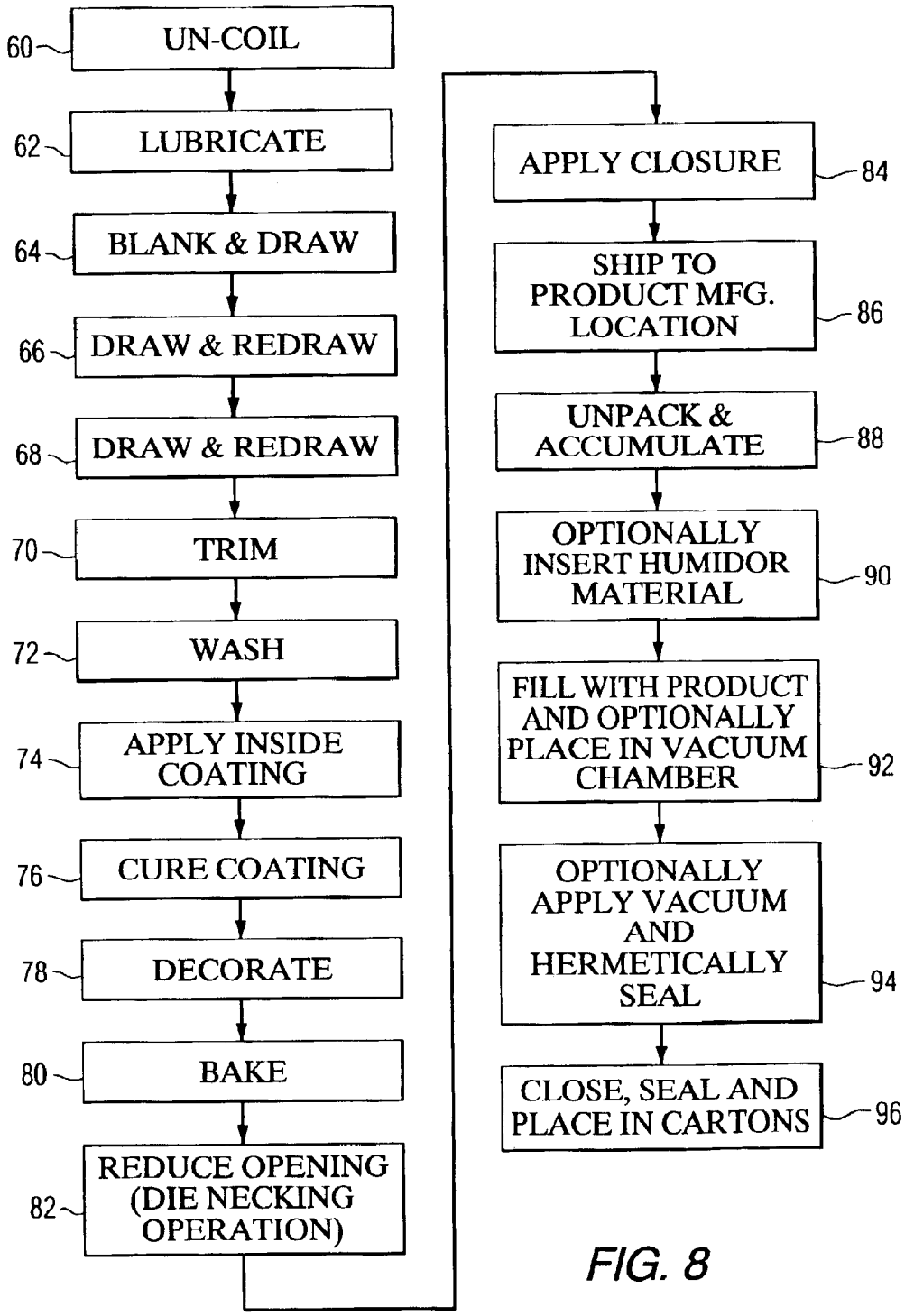
FIG. 8 is a schematic flow chart of one method to make the packaging unit of this invention.

FIG. 8 illustrates the multi-draw process of this invention to produce a deep drawn package with a plastic overcap lid, such as shown in FIGS. 1–7. In FIG. 8 step 60 includes uncoiling strip aluminum sheet, followed by lubricating the sheet 62, if not pre-lubricated, with an oil based, water soluble emulsion, or the like for ease of deep drawing. Then starting at 64, as is well known in the art, blanking a developed or shaped piece of material, preferably aluminum, and then drawing and re-drawing, 66 and 68, at least once using a punch and die to provide the final shape of curved cross-section. The recessed bottom, with surrounding ridge (40) is formed at the end of the press stroke of the final redraw due to the corresponding shape in the punch and die. The formed shape is then trimmed 70, washed 72, coated 74, and cured 76 if required, optionally decorated 78 with a label or brand information, and baked if necessary 80. Optionally, a pre-coated aluminum sheet could be used thus eliminating steps 74 and 76. This can be followed by a die necking operation 82 involving, as is well known, a knock-out, which is inserted into the open section of the formed container, and a die that is pushed over the exterior of the container which reduces the opening dimensions.

This provides the unit 10 shown for example in FIG. 1, without the cap or lid 22. The unit may be in a single piece or another top piece can be cut from an indented bottom piece and joined together at 18, as shown in FIG. 1, but not described in FIG. 8. The closure top can then be applied, step 84, followed by shipping, unpacking and optionally inserting a humidor material, steps 86, 88, and 90 respectively.

If the container is to be hermetically sealed, the container filled with its contents can be placed 92 in an appropriate vacuum unit chamber device and then, while in the vacuum state, closed or sealed 94 and after releasing the vacuum, placed in cartons 96.

While the specification has emphasized the preferred embodiments of FIGS. 1–7, other possible packaging units embodiments are shown in FIGS. 9–11. In FIG. 9, which shows a shallow drawn type unit, split up the sides and bottom at seam 18, the front 12 and back are still curved, while the sides are flat as shown. The bottom would preferably have the same recessed bottom as shown in FIGS. 5–6. The front and back halves would be mechanically seamed or preferably laser seam welded followed by the application of a top closure as previously discussed. This, as well as the units shown in the following FIGS. 10–11 provide a fairly inexpensive design and can use the lids described previously and shown, for example in FIGS. 2–4.

In FIGS. 10 and 11, a section of a roll formed unit is shown. For this package a narrow width sheet is uncoiled and directly fed into a roll-forming unit. A series of rolls deforms the sheet into a tube with the desired shape and produces a mechanical seam 18. The tube is then cut to the appropriate length. Again the front 12 and back 14 are curved and the sides are preferably flat. This design, as well, while stable at the bottom usually would not have the ridge shown in FIGS. 5–6 since it would be less costly to simply have a flat bottomed piece seamed into the base. However, this does not preclude the ridge design shown in FIGS. 5–6 depending on end use and sophisticated design.

The process shown in FIGS. 9–11 would facilitate the use of either pre-coated or pre-decorated sheet, which enables a dry forming process and eliminates concerns associated with a wet lubricant. Additionally, the front panels could be embossed for increased visual attractiveness. The process described would also produce minimal metal scrap due to trimming processes.

This invention provides numerous advantages for packaging various materials, especially perishable materials such as cigarettes. Use of aluminum offers a package with increased rigidity for product protection and provides opportunity to provide cigarettes to customers with increased freshness. The aluminum package offers potential for overpressurization or vacuum packaging that not only would add to overall freshness, but provide an audible sound to the customer which would distinguish the product. The aluminum package will also have environmental advantages. Since the cigarettes will be inserted directly into the package and offer an improved seal over paper or paperboard, the foil liner and cellophane overwrap can be eliminated thus reducing post consumer waste. Additionally, by using aluminum the package can be recycled after use. The aluminum package would preferably be produced from a 3004 type alloy or other alloy, which is compatible with can body stock alloys such that it would be easily absorbed into the can recycling stream. Use of a rigid packaging material also offers the ability to produce the package by different metal forming processes, such as deep drawing. This metal forming process offers flexibility with respect to package shape, thus it is not limited to a rectangular box. The ability to shape and even emboss the surfaces of the aluminum package will provide additional package differentiation.

It should be understood that the present invention may be embodied in other forms without departing from the spirit or essential attributes thereof, and accordingly, reference should be made to both the appended claims and to the foregoing specification as indicating the scope of the invention.

What is claimed is:

1. A packaging unit comprising:

a body portion comprising a curved metal front and curved back metal surface connected by metal sides;

a bottom metal portion that provides stability; and a primary lid having a curved cross-section attached to the body portion along the front, back, and side surfaces of the body portion, and a secondary lid disposed within the primary lid, the secondary lid having a straight hinge across the top surface of the primary lid wherein the straight hinge allows opening of the secondary lid even though the primary lid has a curved cross-section, said packaging unit being capable of being opened and closed repeatedly, wherein the metal is an aluminum alloy having a thickness of from about 0.10 mm to 0.23 mm, the interior of the packaging unit has a plastic coating from about 0.005 mm to 0.018 mm thick to provide a non-reactive interior metal surface, and the packaging unit is a package that contains cigarettes.

2. The packaging unit of claim 1, wherein the lids have rounded top edges and are made of a material selected from the group consisting of plastic and aluminum, and there is no hinging along the back surface of the body portion.

3. The packaging unit of claim 1, wherein the metal is aluminum alloy.

4. The packaging unit of claim 1, wherein the bottom portion has a stable bottom having a central raised exterior bottom surrounded by a ridge.

5. The packaging unit of claim 1, wherein a hermetic seal is created by initial closure of the lids, and use of a foil seal at the interface between the various portions of the packaging unit.

6. A package for cigarettes comprising:

a body portion comprising metal front and curved back metal surface connected by metal sides;

a stable bottom metal portion having a central raised exterior bottom surrounded by a ridge; and a primary lid having a curved cross-section attached to the body portion along the front, back and side surfaces of the body portion, and a secondary lid disposed within the primary lid, the secondary lid having a straight hinge across the top surface of the primary lid wherein the straight hinge allows opening of the secondary lid even though the primary lid has a curved cross-section;

said package being capable of being opened and closed repeatedly, wherein a hermatic seal is created by initial closure of the lids, and use of a foil seal at the interface between the various portions of the package.

7. The package of claim 6, wherein the lids have rounded top edges and are made of a material selected from the group consisting of plastic and aluminum, and there is no hinging along the back surface of the body portion.

8. The package of claim 6, wherein the metal is an aluminum alloy.

9. The package of claim 6, wherein the metal is an aluminum alloy having a thickness of from about 0.10 mm to 0.23 mm, the interior of the packaging unit has a plastic coating from about 0.005 mm to 0.018 mm thick to provide a non-reactive interior metal surface, and the packaging unit is a package that contains cigarettes.

10. The package of claim 6, wherein the ridge provides a stable bottom portion that allows ease of standing upright.

11. The package of claim 6, wherein a moist humidor material is disposed in the bottom of die ridge of the unit, where the ridge provides an interior channel surrounding an interior raised bottom portion.

* * * * *